US005164705A

United States Patent [19]

Dunagan et al.

[11] Patent Number: 5,164,705

[45] Date of Patent: Nov. 17, 1992

[54] ANTI-INTRUSION WINDOW

[75] Inventors: John E. Dunagan, Solon; Stanley Bernath, Pepper Pike, both of Ohio

[73] Assignee: Larmco Security, Inc., Walton Hills, Ohio

[21] Appl. No.: 685,624

[22] Filed: Apr. 15, 1991

Related U.S. Application Data

[63] Continuation-in-part of Ser. No. 480,238, Feb. 15, 1990, Pat. No. 5,007,199.

[51] Int. Cl.[5] ..... G08B 13/08; H01H 3/16

[52] U.S. Cl. ..... 340/547; 49/13; 200/61.72

[58] Field of Search ..... 340/545-549; 200/61.62, 61.71-61.73; 49/13

[56] References Cited

U.S. PATENT DOCUMENTS

| | | | |
|---|---|---|---|
| 700,812 | 5/1902 | Peyton | 335/205 |
| 2,826,656 | 3/1958 | Gordon | 200/61.62 |
| 2,877,361 | 3/1959 | Chase | 307/112 |
| 2,912,540 | 11/1959 | Sawicki | 335/161 |
| 2,922,150 | 1/1960 | Jezl | 340/521 |
| 2,924,682 | 2/1960 | Winterburn | 335/274 |
| 3,161,742 | 12/1964 | Bagno | 335/208 |
| 3,305,805 | 2/1967 | Tann | 335/153 |
| 3,345,627 | 10/1967 | Herst et al. | 340/546 |
| 3,378,830 | 4/1968 | Patrick | 340/546 |
| 3,410,245 | 11/1968 | Kashden | 116/67 R |
| 3,426,166 | 2/1969 | Canceill | 200/61.62 |
| 3,470,554 | 9/1969 | Corbell | 340/513 |
| 3,596,021 | 7/1971 | Saul | 200/61.93 |
| 3,641,540 | 2/1972 | Cutler et al. | 340/547 X |
| 3,710,369 | 1/1973 | Takahashi | 340/547 |
| 3,742,479 | 6/1973 | Williams | 340/545 |
| 3,768,087 | 10/1973 | Kaye et al. | 340/545 |
| 3,771,152 | 11/1973 | Dettling et al. | 340/562 |
| 3,772,669 | 11/1973 | Johnston et al. | 328/59 |
| 3,778,806 | 12/1973 | Williams | 49/13 |
| 3,896,404 | 7/1975 | Peterson | 335/205 |
| 3,943,485 | 3/1976 | Waldman | 340/517 |
| 3,986,183 | 10/1976 | Fujiwara | 340/572 |
| 3,993,988 | 11/1976 | Walter | 340/548 |
| 4,149,156 | 4/1979 | Blasucci | 340/545 |
| 4,160,972 | 7/1979 | La Mell et al. | 340/541 |
| 4,271,338 | 6/1981 | Rakocy | 200/61.71 |
| 4,271,405 | 6/1981 | Kitterman | 340/512 |
| 4,292,629 | 9/1981 | Kerr et al. | 340/547 |
| 4,335,375 | 6/1982 | Schaeffer | 340/539 |
| 4,438,430 | 3/1984 | Young et al. | 340/547 |
| 4,472,709 | 9/1984 | White | 340/546 |
| 4,495,486 | 1/1985 | White | 340/546 |
| 4,686,792 | 8/1987 | Terrian | 49/61 |
| 4,891,626 | 1/1990 | Neuman | 340/547 |
| 4,990,888 | 2/1991 | Vogt et al. | 340/547 X |
| 5,007,199 | 4/1991 | Dunagan et al. | 340/547 X |

FOREIGN PATENT DOCUMENTS

| | | |
|---|---|---|
| 1161183 | 1/1964 | Fed. Rep. of Germany . |

*Primary Examiner*—Jin F. Ng
*Assistant Examiner*—Thomas J. Mullen, Jr.
*Attorney, Agent, or Firm*—Watts, Hoffmann, Fisher & Heinke Co.

[57] ABSTRACT

An anti-intrusion window is disclosed comprising a window frame assembly adapted to be attached to a building structure, first and second sash assemblies supported by the frame assembly and relatively movable with respect to each other, a position indicator supported by one sash, a sensor supported by the other sash and an alarm signal generator activated whenever the position indicator and the sensor are at least momentarily adjacent each other. Multiple windows are coupled to a second alarm signal generator which produces an audible alarm when the first alarm signal generator transmits an alarm signal. The sashes may be moved into cleaning positions without triggering an alarm.

16 Claims, 10 Drawing Sheets

ANTI-INTRUSION WINDOW

RELATED APPLICATION

This is a continuation-in-part of U.S. patent application Ser. No. 07/480,238, filed Feb. 15, 1990 now U.S. Pat. No. 5,007,199, issued Apr. 16, 1991.

BACKGROUND OF THE INVENTION

1. Field of the Invention

This invention relates to windows and more particularly to windows having built-in intrusion alarm systems.

2. Description of the Related Art

Intrusion alarms for windows and doors are typically designed so that window or door movement from a closed position actuates the alarm. Usually a switch is closed by the movement to initiate the alarm as disclosed in U.S. Pat. No. 3,742,479 to Williams. This arrangement requires, in the case of windows, disabling the alarm before opening the window for ventilation purposes or for cleaning. When such windows are opened for ventilation, there is no alarm protection against intruders.

In some prior art proposals, after a window is opened and an alarm is sounded, reclosing the window discontinues the alarm. When a potential intruder opens such a window the alarm may quickly be shut off by the intruder closing the window. In such circumstances a prowler might not be frightened away by the alarm and the prowler's presence not adequately signalled.

Some window alarms are mounted on the window frame. See, for example, U.S. Pat. No. 4,472,709 to White and U.S. Pat. No. 3,378,830 to Patrick. This can result in an unsightly window and may permit tampering with the exposed alarm system by an intruder. Some alarms are constructed to be installed within an existing door or window. For example, see U.S. Pat. No. 3,768,087. Here an installation job is required to place the alarm and tools are necessary to remove the alarm for maintenance or repair.

In the case of double hung windows and so-called "slider" windows, the latter constructed from two horizontally slidable sashes disposed in a common frame for sliding movement past each other, built-in alarms could sometimes be circumvented. For example in double hung windows, the alarm components were sometimes mounted in, or on, the lower sash and the frame, respectively. The sash could be raised sufficiently to enable ventilation without tripping the alarm; but not high enough to admit a prowler without an alarm. In this condition of the window, the possibility existed that the upper window could be forced downwardly far enough to allow entry by an intruder without tripping the alarm. In most installations this kind of alarm circumvention was quite unlikely, yet remained possible.

The present invention provides a new and improved single hung, double hung or slider type window having an intrusion alarm system enabling a window sash to be opened for ventilation without triggering an alarm and wherein further opening of the window without triggering an alarm is precluded.

DISCLOSURE OF THE INVENTION

The present invention provides a new and improved anti-intrusion window comprising a window frame assembly adapted to be attached to a building structure, first and second sashes supported by the frame and relatively movable with respect to each other, a position indicator supported by one sash, a sensor supported by the other sash and an alarm system for producing an intrusion alarm signal in response to the momentary presence of the position indicator near the sensor. The position indicator and the sensor are supported at spaced apart locations when the sashes are in closed positions.

The alarm system comprises first and second alarm signal generators, one associated with the sensor on the sash and the other located remote from the window. The first signal generator transmits an RF alarm condition signal to the second signal generator which in turn produces an alarm.

Further features and advantages of the invention will become apparent from the following description of preferred embodiments made with reference to the accompanying drawings.

DESCRIPTION OF PREFERRED EMBODIMENTS

Figure 1:
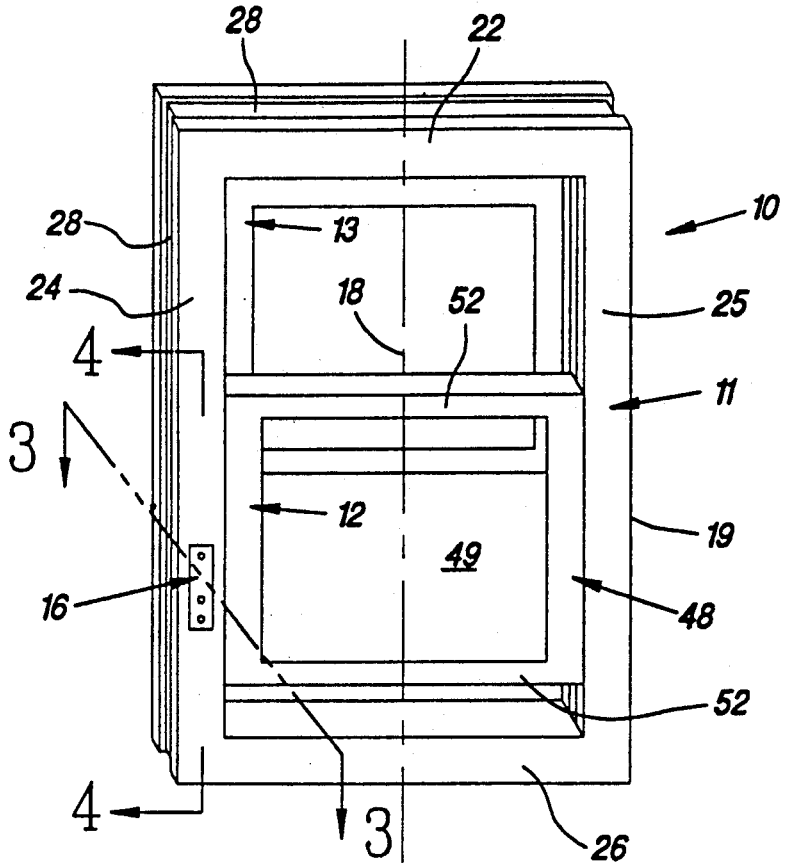
FIG. 1 is a perspective view of an anti-intrusion window constructed according to a preferred embodiment of the invention with a sash assembly in a ventilating position relative to the frame assembly.
Figure 2:
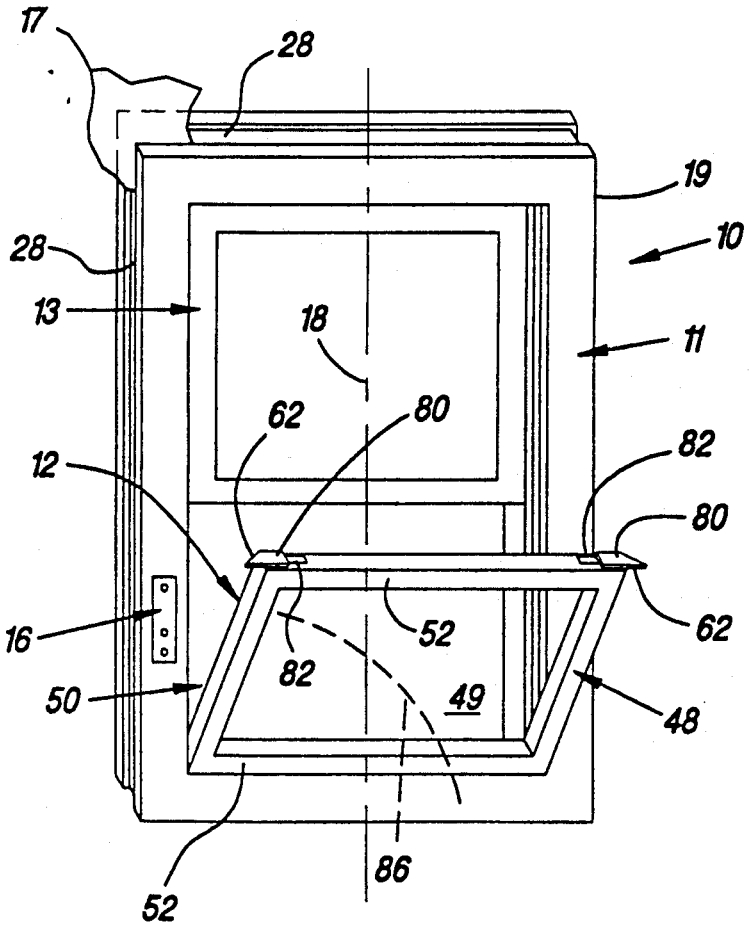
FIG. 2 is a perspective view of the window of FIG. 1 with the sash assembly positioned for enabling the glazing to be cleaned easily from inside.
Figure 3:
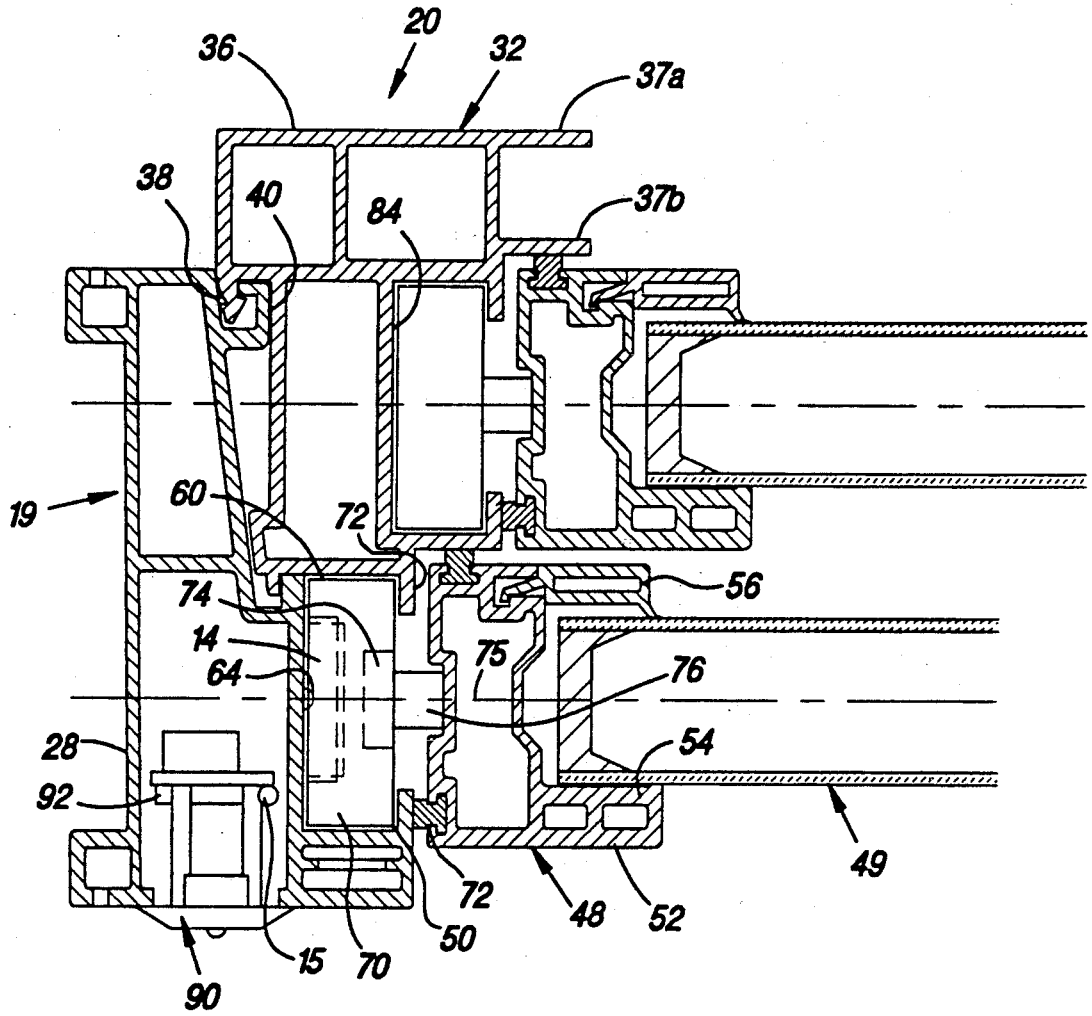
FIG. 3 is a fragmentary cross sectional view seen approximately from the plane indicated by the line 3—3 of FIG. 1.

An anti-intrusion window 10 embodying the present invention is illustrated by the drawings as a double-hung window constructed for mounting in a window opening formed in a building structure. Referring to FIGS. 1-3, the new window 10 comprises a window frame assembly 11, a lower sash assembly 12, an upper sash assembly 13, a position indicator 14 (FIG. 3) supported by one assembly, a sensor 15 (FIG. 3) supported by the other assembly and, an alarm system 16, including an alarm producing device, for triggering an alarm in response to the momentary presence of the position indicator 14 near the sensor 15.

The illustrated frame assembly and the sashes are of a conventional, commercially available design which may be obtained, for example, from the assignee of this application and are known as "Stanley Windows model 400 welded." Because these components are conventional they are described relatively briefly and primarily in terms of their relationship to the alarm system 16, the position indicator 14 and the sensor 15. Furthermore it should be understood that, although a double-hung window is disclosed here, the invention is equally applicable to other types of windows such as single-hung windows, so called "sliders," etc. The illustrated windows are of a kind sometimes thought of as "replacement" windows but they may be used in new construction as well.

The frame assembly 11 maintains the remaining window components assembled as a unit and is constructed and arranged so it can readily be secured to the building wall 17 (FIG. 2) in the place of an original window frame structure. The frame assembly 11 is an open rectangular structure surrounding and supporting both the sash assembly 12 (sometimes referred to as the "lower" sash) and the sash 13 (sometimes referred to as the "upper" sash) for sliding movement from their closed positions along respective paths of travel generally indicated by the line 18.

Figure 8:
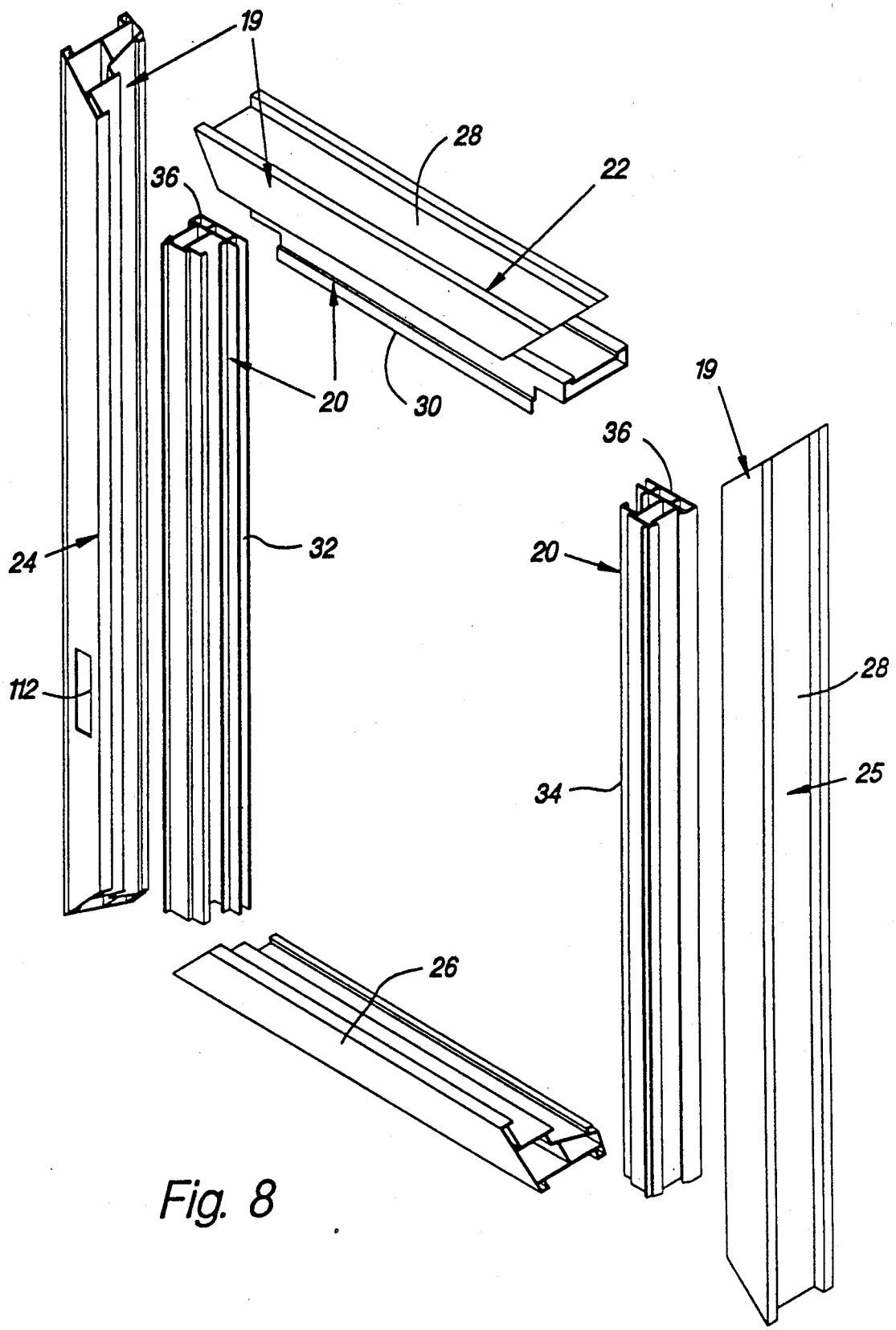
FIG. 8 is an exploded view of a window frame assembly used with a preferred embodiment of the invention.

The frame assembly 11 comprises a base frame 19 secured to the building wall and an adaptor frame 20 (see FIG. 8) secured to and coacting with the base frame 19 to support the upper and lower sashes.

The base frame assembly 19 comprises a head 22 at the upper side of the window, jambs 24, 25 forming opposite sides of the window, respectively, and a sill 26 extending between the jambs to form the lower side of the window. The head, jambs and sill are formed by extruded thermoplastic members having their adjoining ends mitered and welded together to form a flat rectangular frame structure. The head, jambs and sill are essentially hollow tubular structures formed with outer walls supported by stiffening webs and flanges configured so that their cross sectional shapes mate sufficiently at the mitered corners to assure a strong weld joint and a desired external surface configuration. Each extruded member has an external longitudinal channel so that the base frame assembly 19 defines a continuous circumferentially extending channel 28 receiving the building wall structure 17.

The adaptor frame 20 (FIGS. 3 and 8) is constructed and arranged to interfit with the base frame 19 for maintaining the sashes securely assembled in the window and comprises a head adaptor 30 and jamb adapters 32, 34. The adaptor members are formed by extruded tubular thermoplastic members having their adjacent ends mitered and welded together to form a flat rectilinear frame structure which is open along the "lower" side where the sill 26 extends between the free ends of the jamb adapters. The adapters form outer surfaces 36 which face outwardly from the building when the window is installed. The inner periphery of the adaptor frame is formed in part by spaced flanges 37*a*, 37*b* defining a channel between them for receiving a window screen. The flanges 37*b* also define a guide surface along which the upper sash extends.

The adaptor frame 20 is securely fixed to the based frame 19 during fabrication of the window 10. Each adaptor defines a latching flange 38 (FIG. 3) projecting into a keeper flange structure 40 on the base frame when the adaptor frame 20 is pressed into the base frame assembly. This coation permanently locks the frame assembly components together while providing structure for movably supporting the upper and lower sashes.

The sash assembly 12 normally occupies the lower portion of the window area adjacent the sill and comprises a sash frame 48, glazing, in the form of an insulating glass unit 49, fixed in the sash frame, and a mechanism 50 (FIG. 3) for movably mounting the sash assembly to the window frame assembly 11. In the illustrated window 10 the sash frame 48 comprises a rectangular sash body formed by elongated extruded thermoplastic tubular sash members 52 having mitered ends welded together to from sash corners. The inner periphery of the sash frame is defined by a support flange 54 in sealing engagement with the insulating glass unit 49. The unit 49 is clamped in place by retainer frame members 56 (FIG. 3) which are locked to the sash frame and seal against the unit 49.

The insulating glass unit 49 is a conventionally constructed unit which forms no part of the invention. It is schematically illustrated and not described in detail.

The mechanism 50 secures the sash assembly 12 to the frame assembly 11 so that the sash is readily movable relative to the frame assembly. In the illustrated window 10 the mechanism 50 comprises a slide assembly 60 (FIG. 3) movably connected to the frame assembly 11 and at each lower corner of the sash frame, a sash guide 62 (see FIG. 2) engaged between the sash 12 and the frame assembly 11 at each upper corner of the sash 12, and a spring unit (not shown) reacting between the slide assembly and the frame assembly 11 for simulating a window sash counterweight when the sash is raised from its closed position.

Each slide assembly 60 (FIG. 3) guides the sash during movement along the path of travel 18 and is disposed in a guiding trackway 64 extending along the jamb from top to bottom and formed by the juncture of the base frame 19 and the adaptor frame 20. Each slide assembly 60 comprises a shoe 70 slidably disposed in the trackway 64 and captured there by retainer flanges 72, a bushing 74 supported by the shoe 70 for rotation about a bushing axis 75, and a support trunnion 76 anchored to the sash at a lower corner and projecting into the bushing 74 along the bushing axis 75.

Each sash guide projects into the trackway 64 from an upper sash corner to coact with the slide assembly in guiding movement of the sash along the travel path 18. The preferred and illustrated sash guide (FIG. 2) comprises a guide finger 80 supported on the upper side of the sash frame at the sash frame corner with a free end projecting into the trackway. Each finger is biased to its trackway engaging position by a spring 82.

The counterweight simulating spring units are of conventional commercially available construction and prevent the sashes from shifting in their trackways under the force of gravity. These spring units are disposed in the trackways out of sight and since they form no part of the present invention they are neither illustrated nor described further.

The upper sash 13 is disposed in trackways 84 formed in the adaptor frame 20 (see FIG. 3). The upper sash is constructed similarly to the lower sash 12 and therefore a detailed description of the upper sash construction is omitted for the sake of brevity.

The upper and lower sashes are constructed so they can be shifted relative to the frame assembly 11 to cleaning positions where the "outside" of the window glazing is readily accessible to a window cleaner inside the building. In the illustrated window the sashes are shifted to the cleaning position by manually retracting the guide fingers 80 against the biasing spring 82 from their respective trackways and then pivoting the upper side of the sash into the building about the bushing axis 75. The sash thus moves to its cleaning position along an arcuate path of travel indicated by the line 86 in FIG. 2. Once cleaned, the sash is pivoted back to its normal position in the frame assembly and the guide fingers latch into their respective trackways to secure the sash in place again.

The position indicator 14 and the sensor 15 cooperate so that whenever the sash assembly 12 is moved from its closed position along the travel path 18 to, or beyond, a location where the position indicator and the sensor are proximate each other, even momentarily, an alarm is triggered. In the preferred embodiment of the invention the position indicator 14 is mounted on the sash assembly 12 for movement with the sash relative to the frame assembly 11, while the sensor 15 is mounted on the frame assembly 11 at a location chosen so that the sash assembly 12 can be opened to a ventilating position or shifted to its cleaning position without triggering the alarm.

In the preferred and illustrated embodiment, the position indicator 14 is formed by a permanent magnet fixed to one shoe 70 of the slide assembly 60. The magnet is preferably a flat cylindrical member received in a conforming recess in the shoe. The recess opens toward the base wall of the trackway 44 so the magnet is confined in the recess by the trackway wall. Thus whenever the sash assembly 12 is moved in the direction of the travel path 18 the magnet is shifted along the base wall of the trackway 64 relative to the frame assembly 11. Whenever the sash assembly 11 is shifted to its cleaning position the shoe 70 remains stationary as the sash frame and glazing rotate about the bushing axis 75. Thus the magnet does not move relative to the frame assembly 11 when the window is moved to its cleaning position.

The sensor 15 of the preferred embodiment is a magnetically responsive reed switch (see FIGS. 3 and 4) fixed to the frame assembly 11 adjacent the trackway 44 and elevated a predetermined distance away from the sill 26. When the position indicator 14 moves sufficiently close to the reed switch, the magnetic field acts upon and closes the reed switch contacts triggering an alarm. The alarm is triggered even if the position indicator 14 is momentarily in the vicinity of the switch contacts because the reed switch contacts are highly sensitive to magnetic fields and the alarm, once triggered, must be manually reset. The location of the sensor 15 relative to the sill 26 is chosen so that the sash assembly 11 can be raised from its closed position sufficiently to permit building ventilation yet not so far open that an intruder may enter through the window.

The alarm system 16 is built into the frame assembly 11 so that when the window 10 is installed as a replacement, a fully operational alarm is provided as well. The preferred alarm system is manually controlled by the building occupant, signals its operational status when armed to produce an alarm, is easily installed during manufacture and can be removed and replaced by the building occupant for servicing when appropriate. The illustrated alarm system 16 is best seen in FIGS. 3–7 and comprises a support unit 90 detachably connected to the frame assembly 11, alarm circuitry 92 supported by the unit 90 within the frame assembly, an operating key 94, and a power supply 96.

The support unit 90 is constructed and arranged so that it is readily installed in the window frame assembly during manufacturing, provides a decorative yet functional control panel and structurally supports the circuitry 92, the power supply 96 and the sensor 15. The support unit comprises a base plate 100, circuitry supporting legs 102 projecting from the base plate, connecting structure 104 by which the unit 90 is secured to the window frame assembly, and a control panel portion 106 defining an operating key receptacle 108 and a supporting opening for a status indicator 110.

The base plate 100 is a generally rectangular molded plastic member seated on the jamb inside of the building and positioned to cover a rectangular alarm system receiving opening 112 formed in the jamb. The side of the base plate facing the building interior forms the control panel portion 106 while the opposite side of the plate engages the jamb along its peripheral margin. The legs 102 project from spaced locations on the plate through the opening 112 into the tubular jamb. The peripheral edges of the base plate are bevelled and merge into the jamb face to produce a finished, decorative appearance.

The connecting structure 104 detachably secures the base plate in the jamb opening 112 and comprises a mounting tongue 114 fixed to and projecting from the base plate adjacent one edge 115*a* and a latch element 116 projecting from a location adjacent the opposite edge 115*b*. The tongue 114 includes an offset portion 120 and a projecting tang portion 122 extending parallel to the base plate plane. The jamb wall is snugly received between the tang and the base plate to secure the base plate to the jamb. The support unit is installed by inserting the circuitry 92 and its supporting legs 102 into the opening 112 with the base plate angled relative to the plane of the jamb face so the tongue 114 projects through the opening 112 and along one edge.

When the jamb wall edge abuts the tongue offset portion 120 the base plate is rotated about the location of engagement to move the latch element 116 into the opening 112. The latch element 116 operates to secure the base plate to the jamb. The latch element 116 is formed by a resiliently deflectable projecting stem 124 having a ramp face 126 and an adjacent contoured keeper face 128 at its end. When the latch element is aligned with the jamb opening edge opposite the tongue 114 the base plate is pressed toward the opening 112 so the stem 124 resiliently deflects as the ramp face 126 passes across the edge of the opening 112. When the keeper face 128 is moved to engagement with the opening edge the keeper face contour forces the latch fully into the opening under the resilient force supplied by the deflected stem. The base plate snugly engages the jamb face before the stem 124 has fully straightened and relaxed so the base plate is effectively maintained biased into engagement with the edges of the jamb opening 112. Because it is smoothly contoured, the keeper face 128 can ride back and forth over the jamb opening edge to enable the support unit to be installed and removed as necessary for maintenance.

The alarm circuitry 92 comprises a conventional supporting substrate 130 (such as a phenolic "printed circuit" board or a "thick film" cermet element) carrying a network 132 of conductors and electrical circuit elements coacting to provide alarm functions. The substrate 130 is fixed to the projecting ends of the legs 102 by conventional fasteners so that the substrate 130 extends generally parallel to the base plate inside the hollow jamb structure. In the preferred embodiment of the invention, and as best seen in FIG. 3, the sensor 15 is supported on the substrate 130 immediately adjacent the base of the trackway 64 in which the position indicator 14 moves so that the sensor is actuated when the position indicator and sensor are proximate each other.

Figure 7:
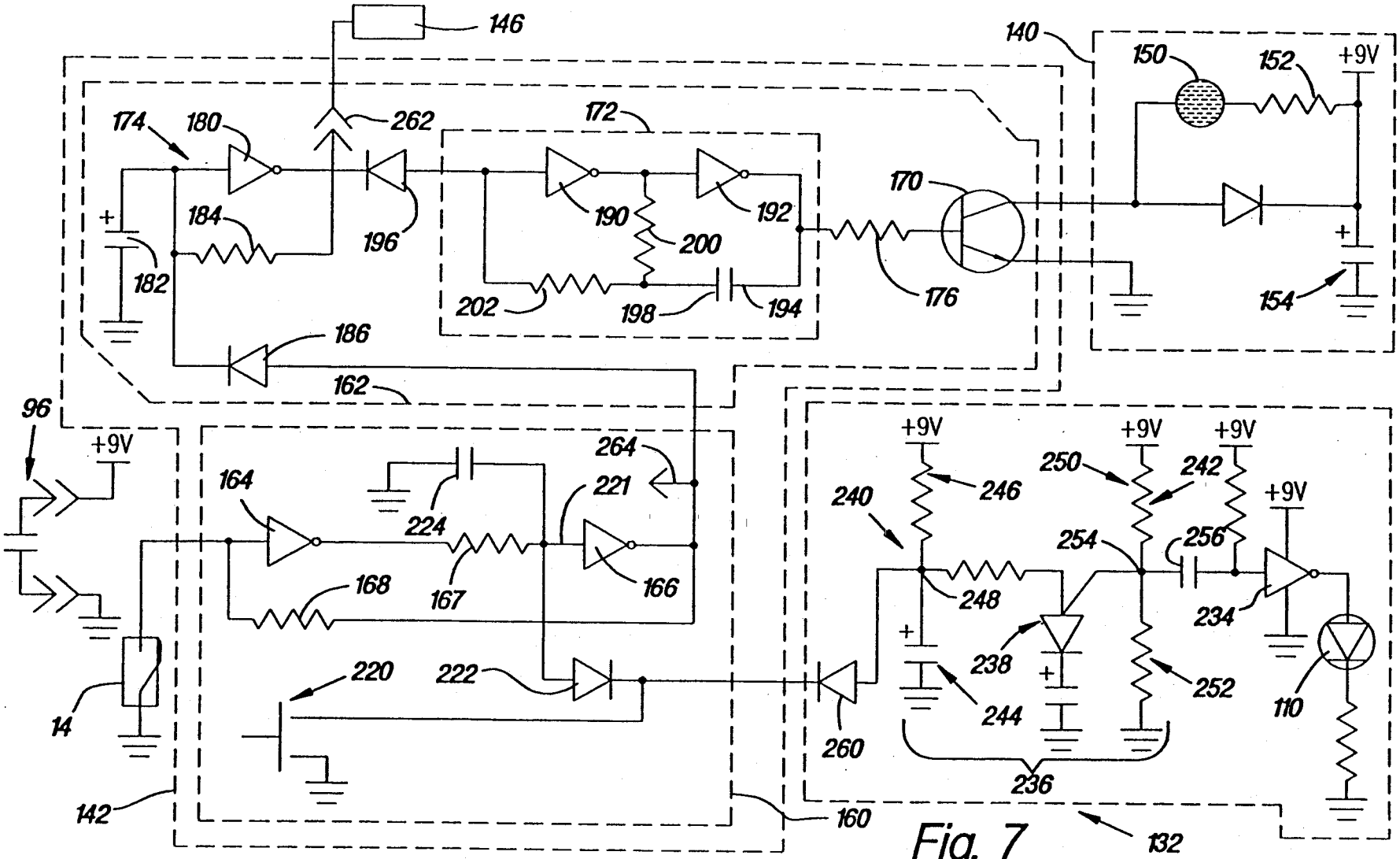
FIG. 7 is a schematic illustration of alarm unit circuitry forming part of the anti-intrusion window.

A preferred alarm circuit network 132 is schematically illustrated by FIG. 7 of the drawings and comprises an alarm driver circuit 140, a signal processing circuit 142, a status indicating circuit 144, and a radio frequency transmitter 146. When the alarm system 16 is armed, the alarm driver circuit 140 is activated by the signal processing circuit 142 whenever the position indicator 14 is detected by the sensor 15, even momentarily, to create a clearly audible intrusion signal.

The alarm driver circuit 140 produces a series of loud horn tones whenever the alarm driver circuit is activated and comprises a coil and diaphragm type horn 150 connected in an oscillator circuit comprised of a resistor 152, the horn coil and a diode 156. The signal processing circuit 142 connects the alarm driver circuit across the power supply 96 (preferably a low voltage direct current power supply or battery) at a rate resonant with the horn oscillator circuit so that the horn 150 sounds loudly whenever the sensor 14 detects the position indicator 15. A conventional power supply bypass capacitor 154 is connected in parallel with the oscillator circuit.

Figure 4:
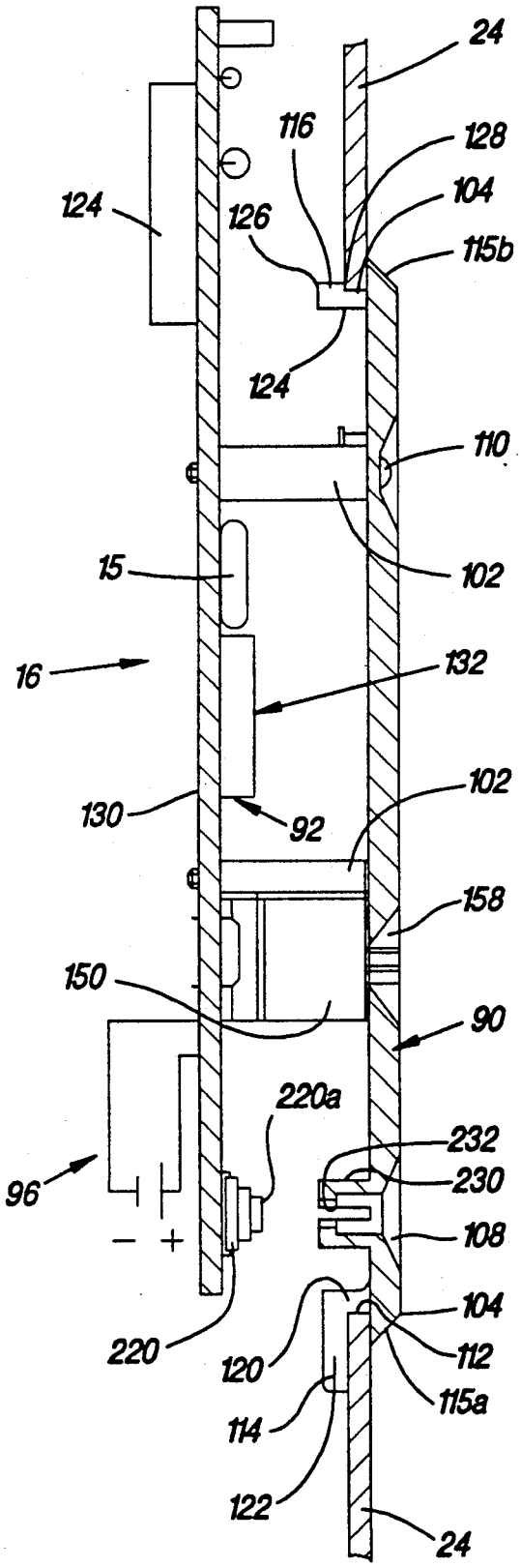
FIG. 4 is an enlarged cross sectional view seen approximately from the plane indicated by the line 4—4 of FIG. 1 with portions broken away.
Figure 5:
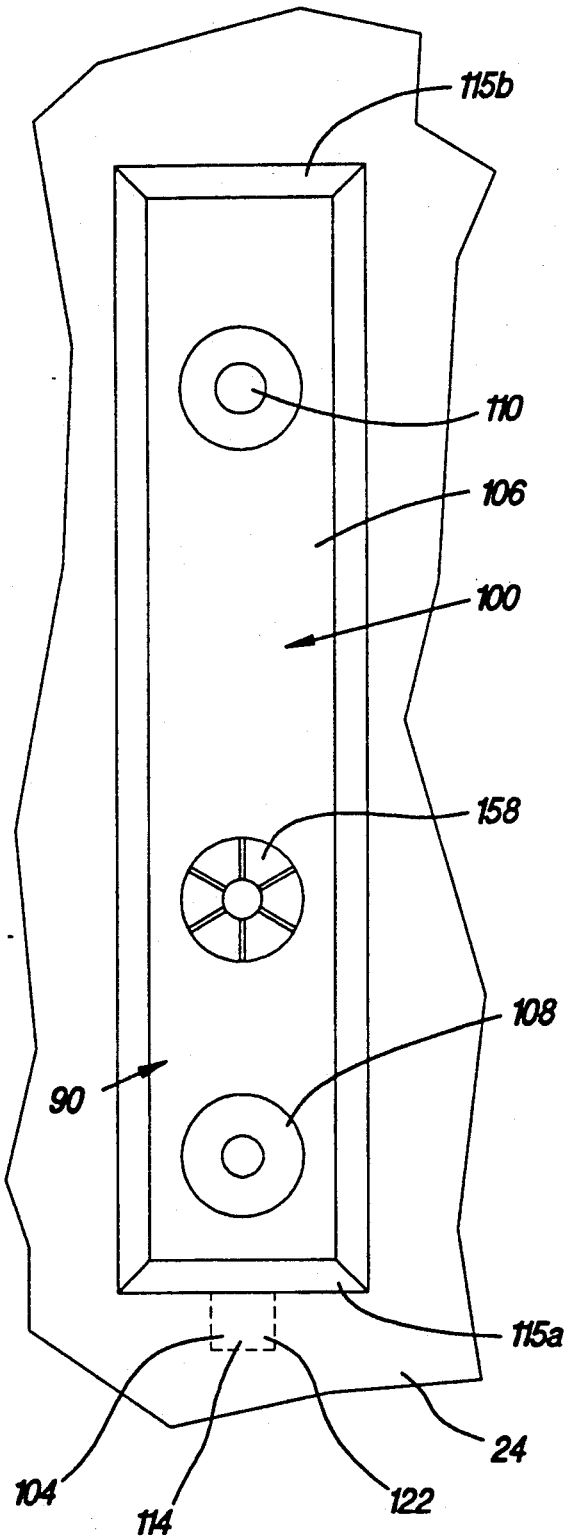
FIG. 5 is a cross sectional view seen approximately from the plane indicated by the line 5—5 of FIG. 4.

As illustrated by FIGS. 4 and 5 the horn is mounted on the substrate 130 immediately adjacent the panel 106 and the panel 106 is provided with a grill-work structure 158 through which the horn blasts are directed into the building. The horn 150 is schematically illustrated and can be of any suitable commercially available construction. In the preferred embodiment of the invention the horn 150 is a Star Micronics QMB-113.

The signal processing circuitry 142 detects even momentary signals from the sensor 14 and operates the horn 150 to produce a series of blasts until the alarm system is manually reset. In the illustrated system the signal processing circuitry 142 comprises a sensor responsive latching circuit 160 for producing a continuous alarm condition signal output in response to the sensor signal and an alarm signal conditioning circuit 162 for producing an alarm horn operating signal in response to the latching circuit output.

The latching circuit 160 is operated by the sensor 14 which, as noted, is a conventional reed switch having a magnetic contact arm which closes on a fixed contact whenever the position indicator magnet is in the vicinity. The preferred latching circuit comprises coacting inverters 164, 166 coupled between the sensor and the signal conditioning circuitry 162. The input of the inverter 164 is connected to the sensor, with the inverter output terminal connected to the input of the inverter 166 through a voltage dropping resistor 167. The output from the inverter 166 is coupled to the signal conditioning circuit and is fed back to the input terminal of the inverter 164 through a latching resistor 168.

Whenever the reed switch contacts close, the input to the inverter 164 is grounded resulting in the output from the inverter 166 going low and operating the signal conditioning circuit so the alarm sounds. At the same time the low output signal is fed back to the input via the latching resistor 168 so the latching circuit output remains low even though the reed switch contacts may reopen immediately.

The alarm signal conditioning circuit 162 comprises an output switch 170 for activating and deactivating the alarm driver circuit, and oscillator networks 172, 174 which coact to govern operation of the output switch 170 in response to the latching circuit output. In the preferred embodiment the oscillator network 172 operates the output switch 170 directly and runs at a frequency which changes the conductive state of the output switch at the natural frequency of the alarm driver circuit. This assures the efficient production of a loud horn tone. The oscillator network 174 is operated in response to an alarm condition output from the latching circuit 160 to enable and disable the oscillator network 172 at a rate suitable to produce a series of horn blasts to minimize power consumption and produce a more noticeable sound.

In the preferred embodiment the output switch 170 is an NPN transistor having its collector-emitter circuit connected in series between the horn 150 and the circuit ground with its base electrode connected to the network 172 via a resistor 176. The network 172 operates at about 2.6 kHz to change the conductive state of the switch 170 at that rate while the network 174 operates a frequency of about 3 Hz so the network 172 is enabled at that frequency. Accordingly the alarm horn 150 produces a series of alarm blasts at about 3 Hz.

The network 174 comprises an inverter 180, a capacitor 182, and a resistor 184 connected to form a low frequency oscillator connected to the latching circuit via a diode 186. Whenever the alarm system is armed but not triggered the latching circuit output is high and the capacitor 182 is charged. When an alarm condition is sensed the latching circuit output goes low which "reverse biases" the diode 186 and prevents it from conducting. The capacitor 182 discharges through the resistor 184 until the inverter input is sufficiently low to change the state of the inverter. When this occurs the inverter output goes high and the capacitor 182 is charged again via the resistor 184. When the capacitor charge level is sufficiently high the inverter changes state again and the process is repeated at a rate of 3 $H_z$. until the latching circuit output goes high (indicating the alarm system has been reset or turned off) precluding further oscillations.

The oscillator 172 is formed of inverters 190, 192 interconnected by a feedback network 194 to form a so-called "racetrack" oscillator activated and deactivated by the oscillator 174. The oscillators 172 and 174 are coupled by a diode 196 which is conductive when the output of the inverter 180 is low and nonconductive when that inverter output is high. When the diode 196 is nonconducting the oscillator 172 runs freely at 2.6 kHz. The frequency is determined by the time constant of the feedback network 194 which includes a capacitor 198, and resistors 200 and 202.

When the diode 196 is initially rendered nonconductive the input to the inverter 190 is enabled to go high, which it does as a result of the capacitor 198 charging through the resistor 200 from the output of the inverter 180. When the input to the inverter 190 goes high its output goes low and the output of the inverter 192 consequently goes high. This renders the transistor 170 conductive so the horn 150 is energized. Meanwhile the capacitor 198 discharges via the resistor 200 until the input to the inverter 190 goes low again. This causes that inverter output to go high, resulting in the output of the inverter 192 going low and turning off the transistor 170. At the same time the capacitor 198 is recharged from the output of the inverter 190 through the resistor 200. The resistor 202 prevents the input of the inverter 190 from going below ground voltage whenever the output of the inverter 192 goes low.

This sequence of events continues at the frequency referred to until the diode 196 is rendered conductive again which precludes the input of the inverter 190 from going high. The effect is that the alarm horn circuit is energized and de-energized by the transistor 170 as its conductive state is switched at 2.6 kHz and an apparently continuous horn blast is sounded. Because the low frequency oscillator periodically deactivates the high frequency oscillator, the horn blasts intermittently at the frequency of the low frequency oscillator i.e. about three Hertz. The horn 150 is fixed to the substrate 130 immediately adjacent the panel 106 in alignment with an array of slots 219 which transmit the horn blasts efficiently into the room in which the window is installed.

The alarm can be stopped by manually actuating a reset switch 220 with the operating key 94. In the preferred embodiment the reset switch 220 is a normally open microswitch, or equivalent, having its operating plunger 220*a* fixed to the substrate 130 in line with the operating key receptacle 108 (see FIG. 4) and its contacts (FIG. 7) connected in a circuit from a junction 221 at the input of the inverter 166 to ground through a diode 222. When the key 94 is inserted to reset the alarm, the reset switch contacts are closed and the inverter 166 changes state because its input is grounded through the diode 222 and the reset switch 220.

The reset switch contacts need only be closed momentarily to disable the alarm and the alarm system is immediately rearmed as soon as the reset switch contacts reopen. In FIG. 7 the junction 221 is illustrated connected to the circuit ground through a transient filtering capacitor 224. The capacitor 224 is small and discharges immediately when the reset switch 220 is closed so there is no noticeable delay in resetting the alarm when the key is pressed into its receptacle to close the reset switch 220. Likewise, when the key is withdrawn, or merely retracted slightly from the switch, the alarm circuitry is immediately armed again because the capacitor 224 rapidly charges.

Because the window and alarm system permit window cleaning as well as enabling opening the window for ventilation without triggering the alarm, the alarm is typically maintained in its armed state all the time. However, the alarm system may be manually turned off by the key 94 and reset switch 220 if that should ever become desirable.

Figure 6:
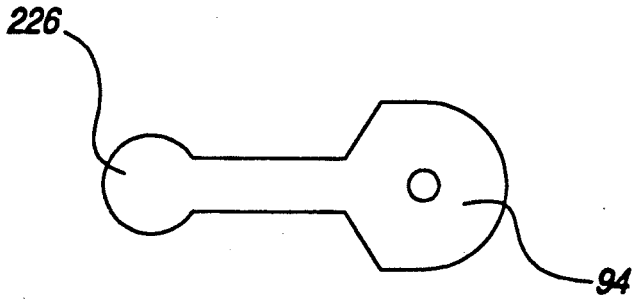
FIG. 6 illustrates an anti-intrusion window alarm unit operating key.

As illustrated by FIGS. 4 and 6 the key 94 and its receptacle 108 are constructed to provide a detent mechanism for maintaining the reset switch contacts closed when the key is fully inserted in the receptacle and left there. The projecting key end 226 is formed to define an enlarged spherically curved bead-like structure (See FIG. 6). The receptacle 108 is provided by an opening in the control panel 106 and key engaging spring legs 230 projecting toward the reset switch plunger from the backside of the control panel. The rearwardly projecting spring leg ends 232 are enlarged and the legs extend adjacent the axis of the receptacle opening so that when the key 94 is inserted the key end 226 moves between the leg ends 232 and resiliently deflects the legs. When the key end 226 moves beyond the leg ends 232 the legs spring back towards each other again. This action maintains the key end gripped by the leg ends and positioned for continuously depressing the reset switch plunger 220*a*.

The detent mechanism also provides an operational "feel" to the key so the user of the window receives a tactile indication when the key has actuated the reset switch 220 as well as when the key has been withdrawn sufficiently from the reset switch that the alarm system is re-armed.

The status indicating circuit 144 produces a sensible indication that when the alarm system is armed by, in the preferred embodiment of the invention, operating the status indicator 110 to produce a blinking light at the control panel surface. The light is visible within the room in which the window is installed. The status indicating circuit comprises the indicator 110, formed by a light emitting diode (LED), an inverter 234 for activating the LED and a timing circuit 236 for controlling the inverter.

The timing circuit produces periodic inverter activating pulses whenever the reset switch 220 is open. The timing circuit comprises an electronic switch 238 formed by a programmable unijunction transistor (PUT) having its control electrodes connected between respective outputs of a charging circuit 240 and a voltage divider circuit 242. When the reset switch is open a capacitor 244 in the charging circuit charges via a resistor 246 to create a positive going voltage at an output junction 248. The voltage divider circuit is formed by resistors 250, 252 and an output junction 254 connected to the PUT. When the voltage at the junction 248 increases to a level which is one diode voltage drop above the voltage at the junction 254 the PUT is rendered conductive and establishes a highly conductive path in parallel with the resistor 252. Consequently the voltage at the junction 254 abruptly drops to circuit ground and the capacitor 244 discharges through the PUT.

The junction 254 is coupled to the input of the inverter 234 by a capacitor 256 so that when the PUT is rendered conductive the negative going voltage at the junction 254 reduces the input voltage level at the inverter input resulting in the inverter output voltage going high and energizing the LED. When the charging circuit capacitor 244 discharges sufficiently that the PUT becomes nonconductive again the inverter input voltage level goes high and the LED is turned off. This process repeats itself at a frequency determined primarily by the values of the resistor 246 and the capacitor 244. The circuit elements in the status circuitry chosen to produce impedances which are as large as practical so minimal current is drawn by the circuitry. The LED blinks every few seconds until the reset switch 220 is closed which interrupts the status circuitry operation.

The reset switch 220 is closed to disable the charging circuit and prevent the LED from being illuminated. The reset switch 220 and status indicating circuitry 132 are coupled by a diode 260 connected between the junction 248 and the reset switch contacts. The diode 260 is poled so that when the reset switch contacts close the diode conducts from the junction 248 to circuit ground. This prevents charging the capacitor 244.

The radio frequency transmitter 146 is of any conventional or suitable type and is operable from the alarm system to transmit an R. F. signal to an appropriate receiver so that a remote alarm can be produced. By way of example, the transmitted radio signal may be used to operate an automatic telephone dialer in the building which then signals an alarm condition to a remote location. Depending on the type of transmitter selected for use, the transmitter input may be connected to the alarm circuitry at transmitter output terminals 262 or 264.

The power supply 96 can be of any suitable low voltage type, but in the preferred embodiment of the invention the power supply is a conventional 9 volt battery connected to the substrate by power lines and detachable battery terminal connectors. Hence the battery 96 can be removed and replaced should it lose power over time. Removal and replacement is made relatively easy by the support unit construction.

FIGS. 9–15 illustrate a modified anti-intrusion window 300 embodying the invention. The window 300 comprises a window frame assembly 302 adapted to be attached to a building structure (not illustrated), first and second sash assemblies (sashes) 304, 306 supported by the frame assembly 302 and relatively movable with respect to each other, a position indicator 308 supported by one sash, a sensor 310 supported by the other sash and an alarm system 312 (FIG. 10) for producing an alarm in response to the momentary presence of the position indicator near the sensor. The system 312 is commercially available as the LS 200 Wireless Security System from Larmco Security, Inc., 7160 Krick Road, Cleveland, OH 44146-9955.

The illustrated window 300 is constructed and arranged so that it can be used as one window in a network of anti-intrusion windows coupled to a central alarm unit; however the window 300 can be used as a single anti-intrusion window if that is preferred.

Except where otherwise indicated below the frame assembly 302 and sashes 304, 306 are substantially the same as illustrated and described in reference to FIGS. 1–8. Therefore detailed descriptions of these components of the window 300 are omitted. Reference to the descriptions above should be made for an understanding of these features.

Figure 9:
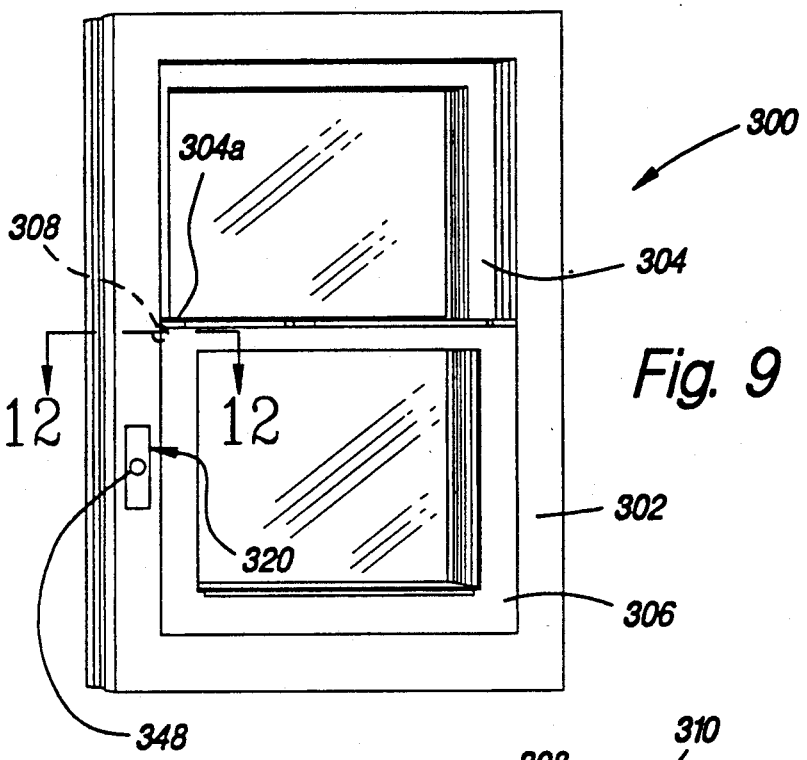
FIG. 9 is a schematic perspective view of a modified anti-intrusion window constructed according to the invention.

The window 300 differs from those of FIGS. 1–8 in that the position indicator 308 and the sensor 310 are disposed in the respective sashes 304, 306. Accordingly when either sash is moved from its closed position past a predetermined, open "ventilation" position the position indicator and the sensor are at least momentarily juxtaposed causing an alarm signal. While a so called "double hung" window is illustrated in FIG. 9, it should be appreciated that the window 300 could be a single hung window, a "slider" type window, or a patio door.

Figure 10:
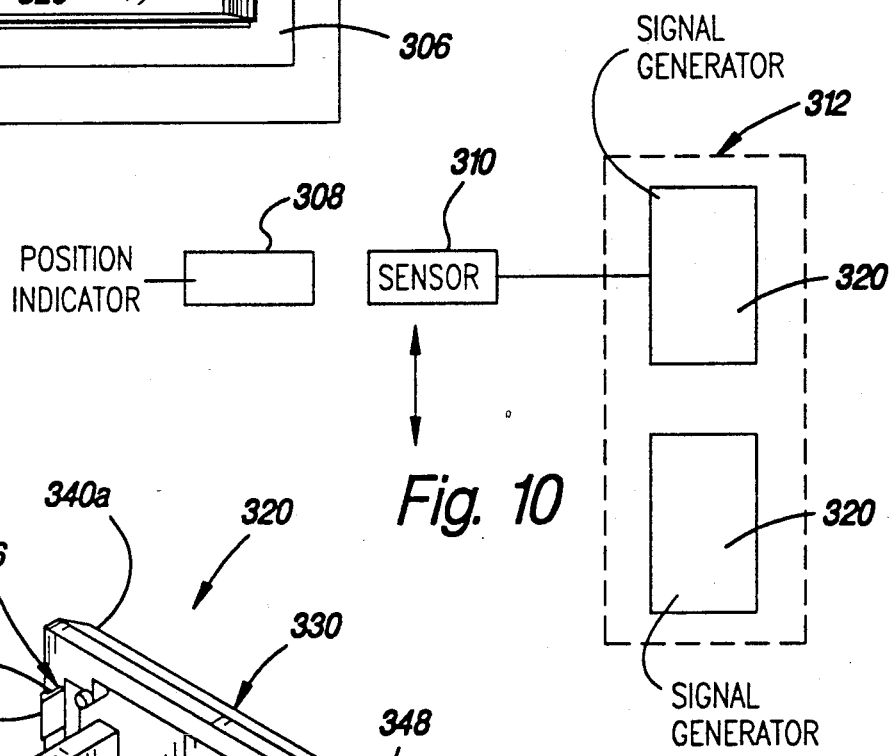
FIG. 10 is a diagrammatic view of components of the anti-intrusion window of FIG. 9.

FIG. 10 schematically illustrates the position indicator 308, the sensor 310 and the alarm system 312 with the sensor and position indicator juxtaposed as they would be when an alarm condition is created. The sensor 310 detects the presence of the position indicator 308 and activates the alarm system 312 so that an alarm is produced.

The position indicator 308 is formed by a small, powerful permanent magnet, in the form of a thin disc, fixed to the sash 304 at a lowermost sash corner 304*a*. See FIGS. 9 and 12. There the magnet location is immediately adjacent and covered by the lower sash 306 at all times except when the lower sash is pivoted to its cleaning position. In the illustrated and preferred window the magnet is fixed to the sash 304 by a short length of vinyl tape 314 (see FIG. 12) which is adhered to both the sash 304 and the magnet. The vinyl tape 314 is the same color as the sash 304 and provides an extremely effective yet inexpensive and simple means of securing the magnet in a position nearest the sensor location in the lower sash 306.

The sensor 310 is preferably formed by a reed switch fixed in the sash 306 in alignment with the magnet location. When the magnet and the reed switch are adjacent each other the magnetic field created by the magnet is effective to actuate the normally open switch contacts 310A to their closed position which in turn activates the alarm system 312. The reed switch is fixed to the sash at a location sufficiently far from the magnet, when the sashes are fully closed, that the sash 304 or the sash 306, or both, may be opened somewhat for ventilation purposes without triggering an alarm.

In the illustrated embodiment the alarm system 312 comprises a first alarm signal generator 320 connected to the sensor 310 for producing an intrusion indicating output signal and a second alarm signal generator 322 responsive to the first signal generator output for producing an output alarm signal. It should be appreciated that the alarm system 312 may be constructed to provide one signal generator 320 for each window 300 with each signal generator constructed to provide an audible intrusion alarm itself; however in the illustrated system 312, the alarm signal generator 322 is located remote from the signal generator 320 and is constructed and arranged to coact with each of a number of remote window mounted signal generators 320 which do not themselves produce audible alarms.

Figure 11:
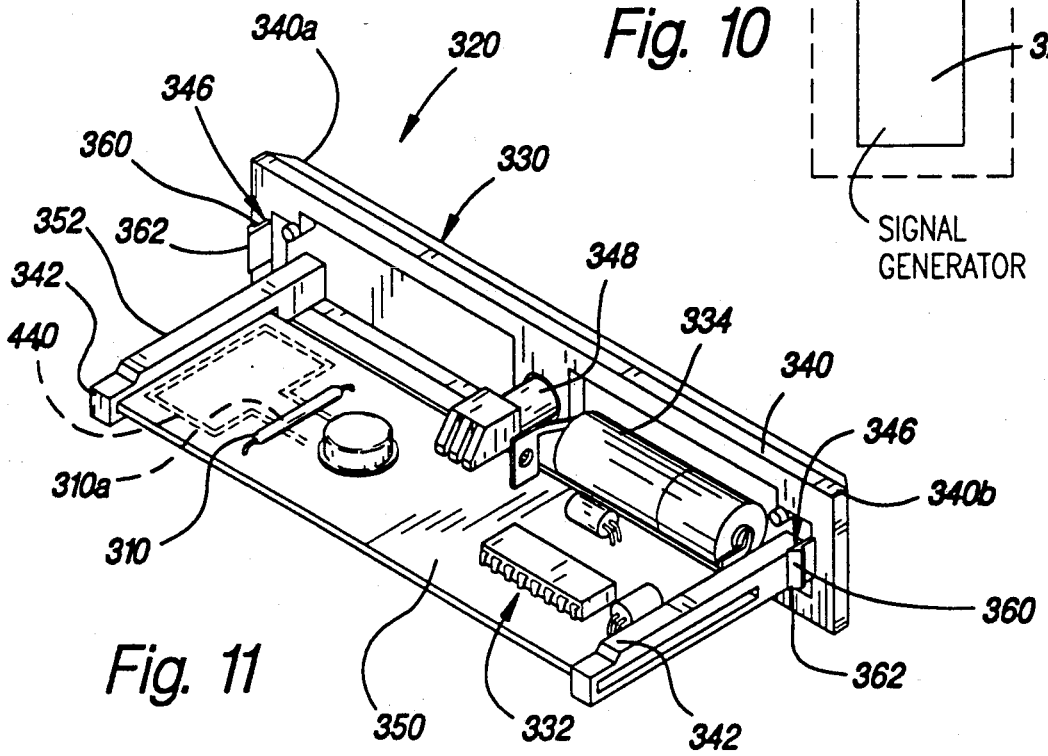
FIG. 11 is a perspective view of a component illustrated in FIG. 9.
Figure 12:
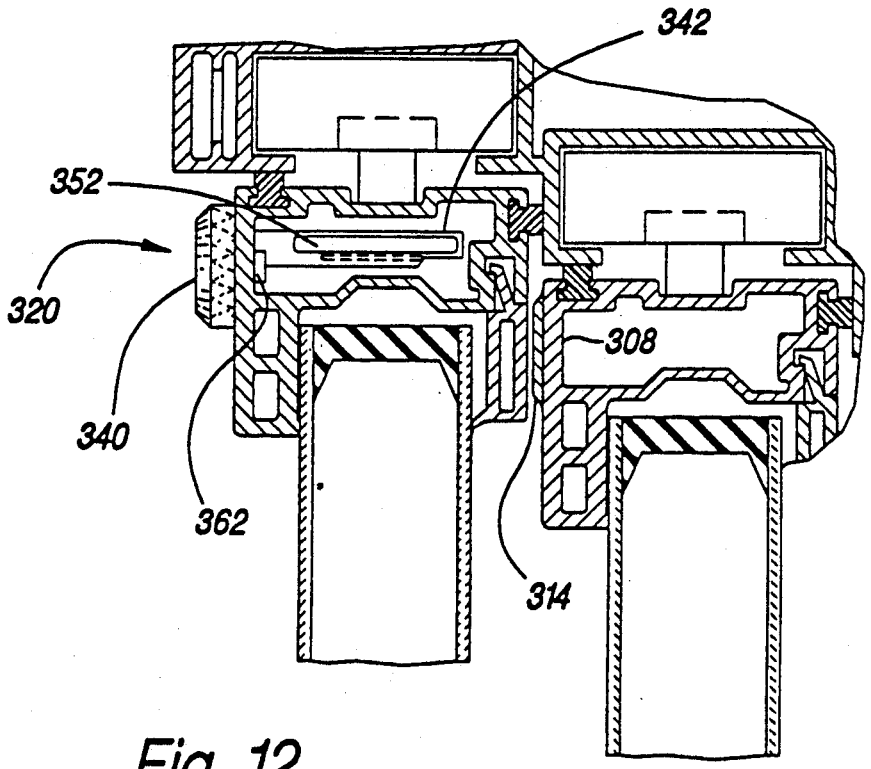
FIG. 12 is a fragmentary cross sectional view seen approximately from the plane indicated by the line 12—12 of FIG. 9 and on a scale which is enlarged from that of FIG. 9.

In the embodiment illustrated by FIGS. 9–15 the signal generator 320 is carried by the sash assembly 306 and is electrically connected across the reed switch contacts 310A. The signal generator 320 is best illustrated in FIGS. 11 and 12 and is commercially available as Model WT-200 Wireless Remote/Window Transmitter from Larmco Security, Inc., 7160 Krick Road, Cleveland, OH 44146-9955.

When the reed switch contacts 310A close, the signal generator 320 produces a coded, radio frequency output signal which is transmitted to the signal generator 322. The RF output signal is coded to indicate the location of the window 300 and is transmitted for a brief interval when an alarm condition occurs. The signal generator 322 forms an RF signal receiving alarm unit located remote from the window 300. When the signal generator 322 detects the coded output signal it responds by producing an audible alarm and an indication of the window location where the alarm condition exists.

The signal generator 320 is assembled into the sash assembly 306 so that when the window 300 is installed a fully operational alarm is provided. The preferred signal generator 320 comprises a support unit 330 detachably connected to the sash 306, a signal generator circuit 332 and a power supply 334 formed by a battery.

The support unit 330 is constructed and arranged so that it is readily installed in the window frame assembly during manufacturing and structurally supports the signal generator circuit 332, the power supply 334 and the sensor 310. The support unit is received in a rectangular sash opening cut in the face of the sash 306, and comprises a base plate 340, signal generator circuit supporting legs 342 projecting from the base plate, connecting structure 346 by which the unit 330 is secured to the sash assembly, and a circuit status indicator 348.

The base plate 340 is a generally rectangular molded plastic member which covers the rectangular sash opening and is seated on the sash facing the inside of the building. The side of the base plate facing the building interior forms a panel in which the status indicator 348 is supported while the opposite side of the plate engages the sash about its peripheral margin. The peripheral edges of the base plate are bevelled to produce a finished, decorative appearance.

The legs 342 project from spaced locations on the plate 340 through the opening and into the sash. The legs 342 are continuously molded with the base plate and support the signal generator circuit between them in the sash. The signal generator circuit 332 includes a substrate 350 (on which the circuit components are mounted) formed by a circuit board which extends between receiving slots 352 in the legs. The power supply battery and sensor 310 are also supported on the substrate 350.

The connecting structure 346 detachably secures the base plate in the sash opening and comprises resilient latch fingers 360 projecting from locations adjacent the opposite base plate ends 340*a*, 340*b*. Each finger 360 has a latching element 362 disposed at its projecting end for resiliently securing the base plate to the sash. The support unit is installed by inserting the legs 342 into the sash opening and pressing the plate so that each latch element 362 engages the adjacent edge of the sash opening and resiliently deflects the finger 360. As the latch element passes the sash opening edge each finger 360 springs back toward its undeflected position and resiliently maintains the signal generator 320 in position.

The signal generator can be removed from the sash to replace the battery, for example, by gently prying the base plate away from the sash which unlatches the fingers from the sash. The signal generator is replaced the same way it is initially installed.

Figure 14:
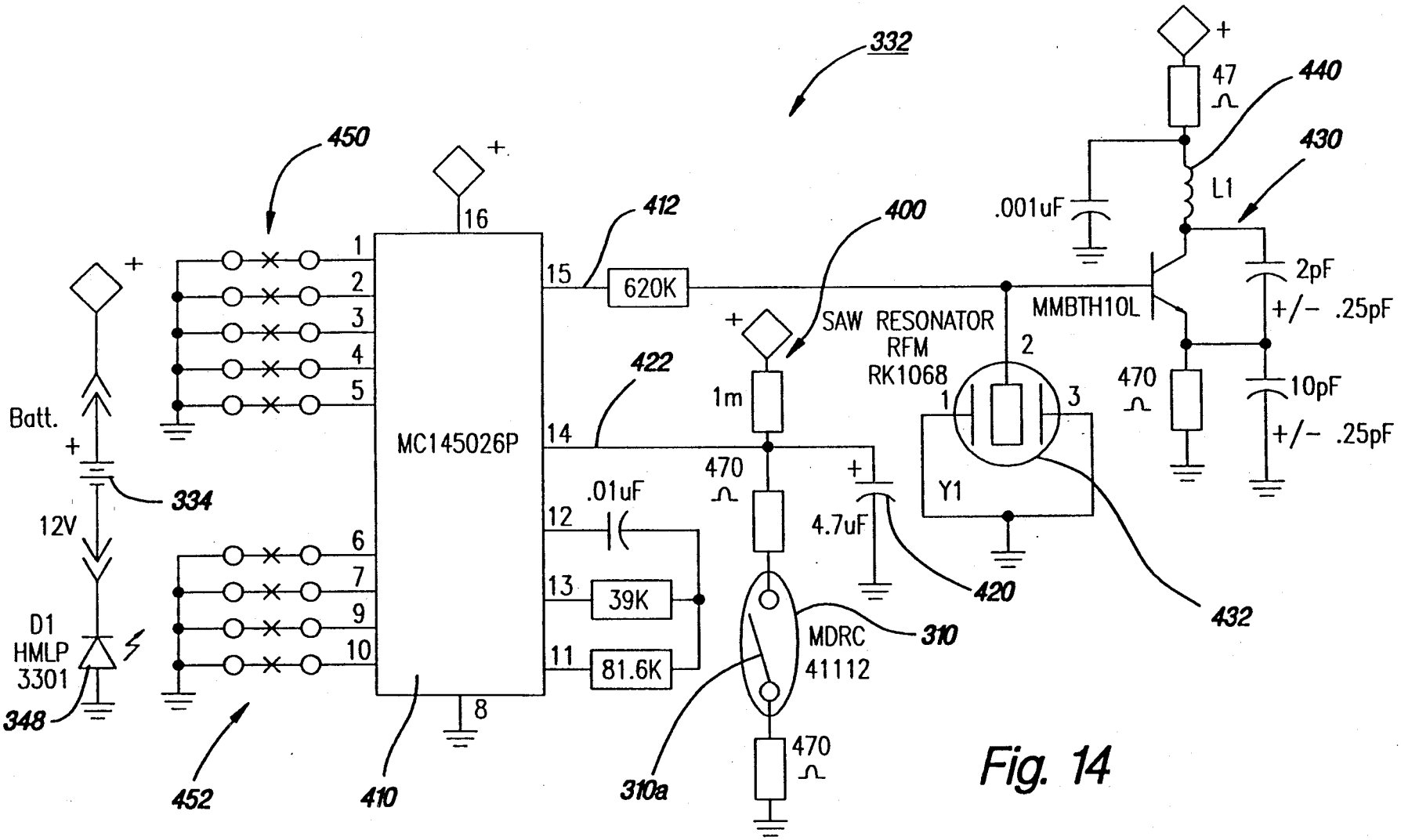
FIG. 14 is a schematic illustration of alarm unit circuitry forming part of the anti-intrusion window; and, FIGS. 15A and 15B are schematic illustrations of additional alarm unit circuitry forming part of the anti-intrusion window.

The signal generator circuit 332 is illustrated schematically in FIG. 14 and comprises an RF signal encoder circuit 410 for generating a unique output in response to closure of the reed switch contacts 310A. The encoder 410 is an integrated circuit commercially available under the designation MC145026P. The encoder 410 responds to an input from the sensor 310 by generating a series of output signals at an encoder output 412. The sensor 310 forms a part of a voltage divider circuit coupled to a 12 volt signal from a power supply which in the preferred embodiment of the invention is a replaceable 12 volt battery. Each time the reed switch contacts 310A close, a capacitor 420 coupled to the divider circuit discharges through the switch. This causes an input 422 to the encoder 410 to be pulled low which in turn causes an output string to be generated at the output 412. After approximately 3 seconds, the capacitor 420 charges through the internal resistance of the encoder 410 and the signal from the encoder output 412 stops. This in turn terminates the RF output signal.

The status indicator 348 is preferably formed by a light emitting diode which is illuminated during the time the output string is generated by virtue current drawn by the signal generator circuit 332. The indicator 348 is used to test the battery 334. With the signal generator 322 turned off so no alarm can be produced, the sash 306 is raised until the indicator 308 and the sensor 310 are magnetically coupled. An RF signal is generated and the indicator 348 is illuminated but no alarm sounds. If the battery has run down the RF signal is not generated and the indicator 348 is not illuminated.

The output 412 is coupled to an oscillator circuit 430 that oscillates at a frequency of 303.87 megahertz. This frequency is controlled by an SAW resonator 432 operating in series resonant mode. In response to the output from the encoder 410 the oscillator 430 oscillates and creates an RF signal that is transmitted to the signal generator 322.

In the disclosed embodiment of the invention, an inductor 440 forming part of the oscillator circuit 430 acts as an antenna. The antenna is formed integrally with the circuit board 350 (see FIG. 11).

The make up of the signal from the output 412 is determined by a sequence of inputs to the encoder circuit 410. A first sequence of five inputs 450 coupled to pins 1–5 of the encoder 410 generate a security code that is common to all encoders whose signals are monitored by the second signal generator 322. The use of five inputs to the encoder allows a choice of 32 different security inputs thereby avoiding interference with other security systems which may be located in nearby buildings, adjacent apartments, or the like. A second sequence of inputs 452 is coupled to the encoder 410 to convey a window location, or zone, indication signal. This indication is used to identify the location of the window experiencing an alarm condition. The information designated by each of the inputs 450, 452 is encoded onto the output 412 each time the switch contacts 310A close and each is transmitted to the second signal generator 322.

Programming the inputs 450, 452 is accomplished by selectively removing ground connections at each encoder input. If a ground connection is left intact an associated encoder pin is grounded whereas if the ground connection is removed the pin floats above ground. Initially all the encoder pins are grounded. Attendant installation of the signal generator in the window 300 selected ground connections are removed to code the output signal. It should be appreciated that so called "dip" switches can also be used to enable coding the signal.

Figure 13:
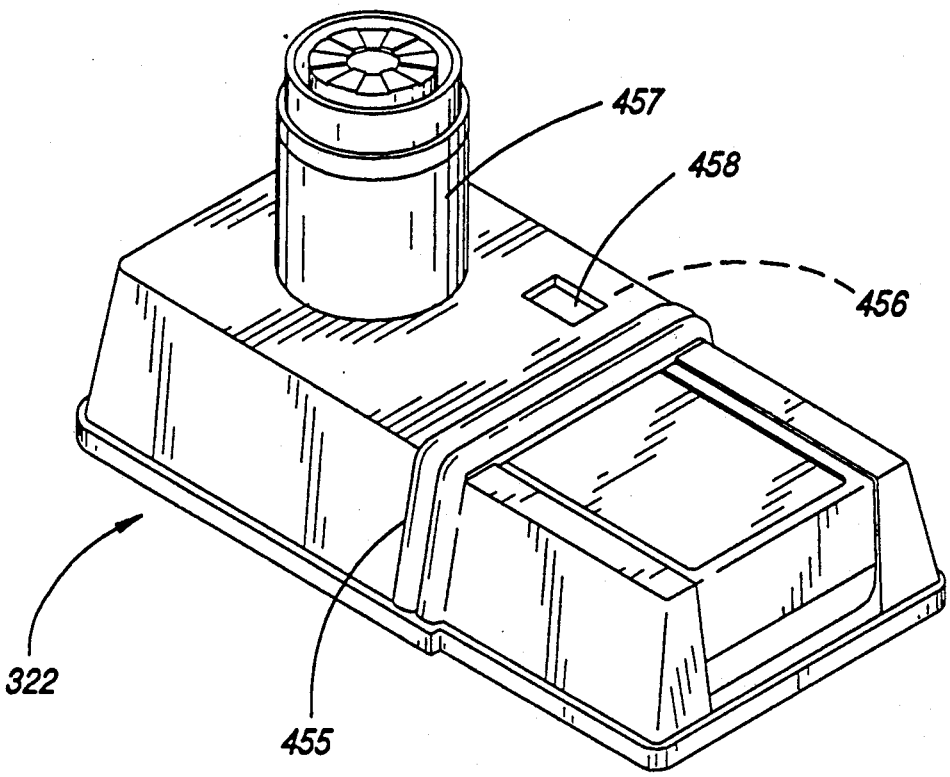
FIG. 13 is a perspective view of a component illustrated in FIG. 10.
Figure 15A:
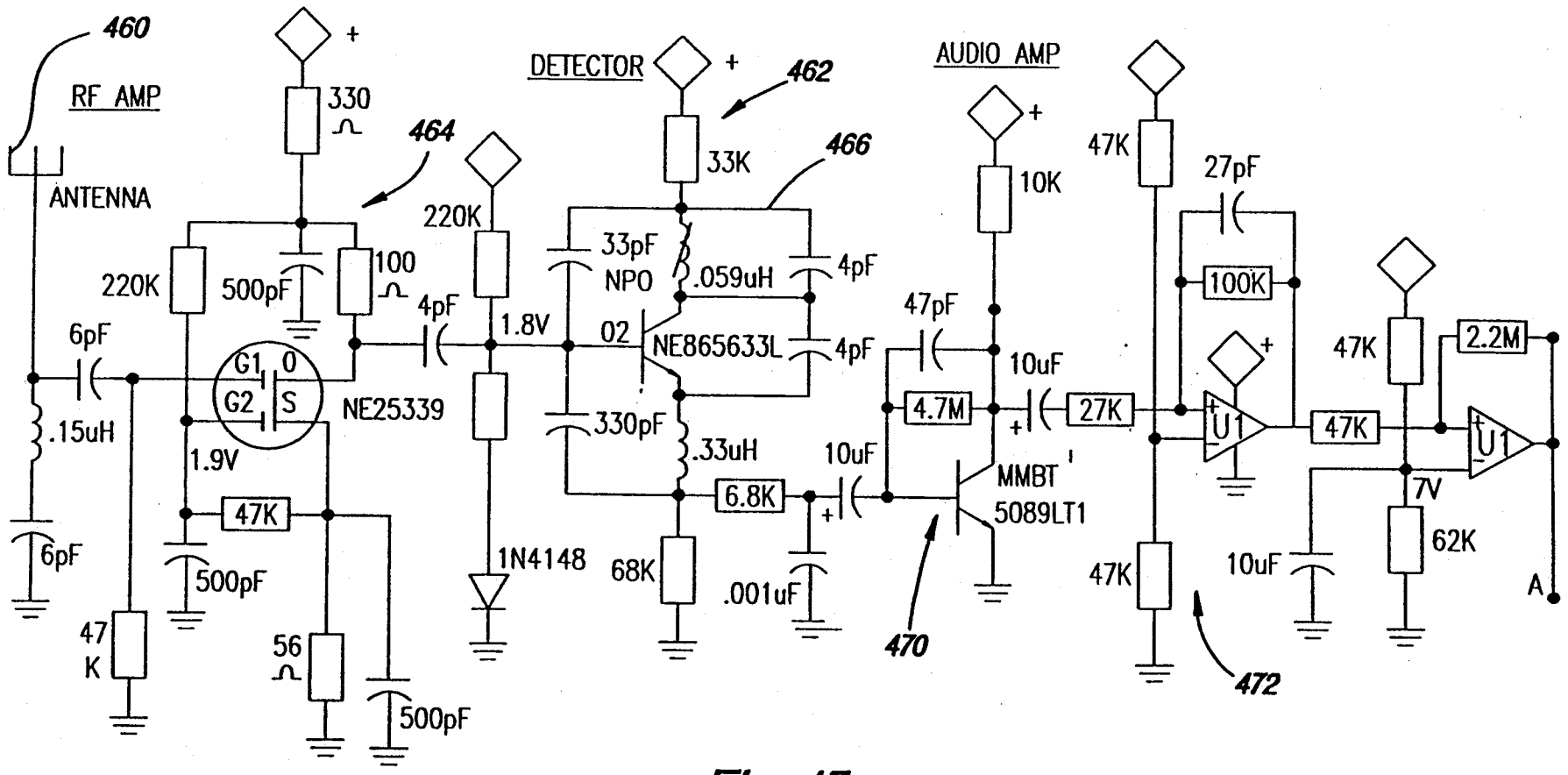
Figure 15B:
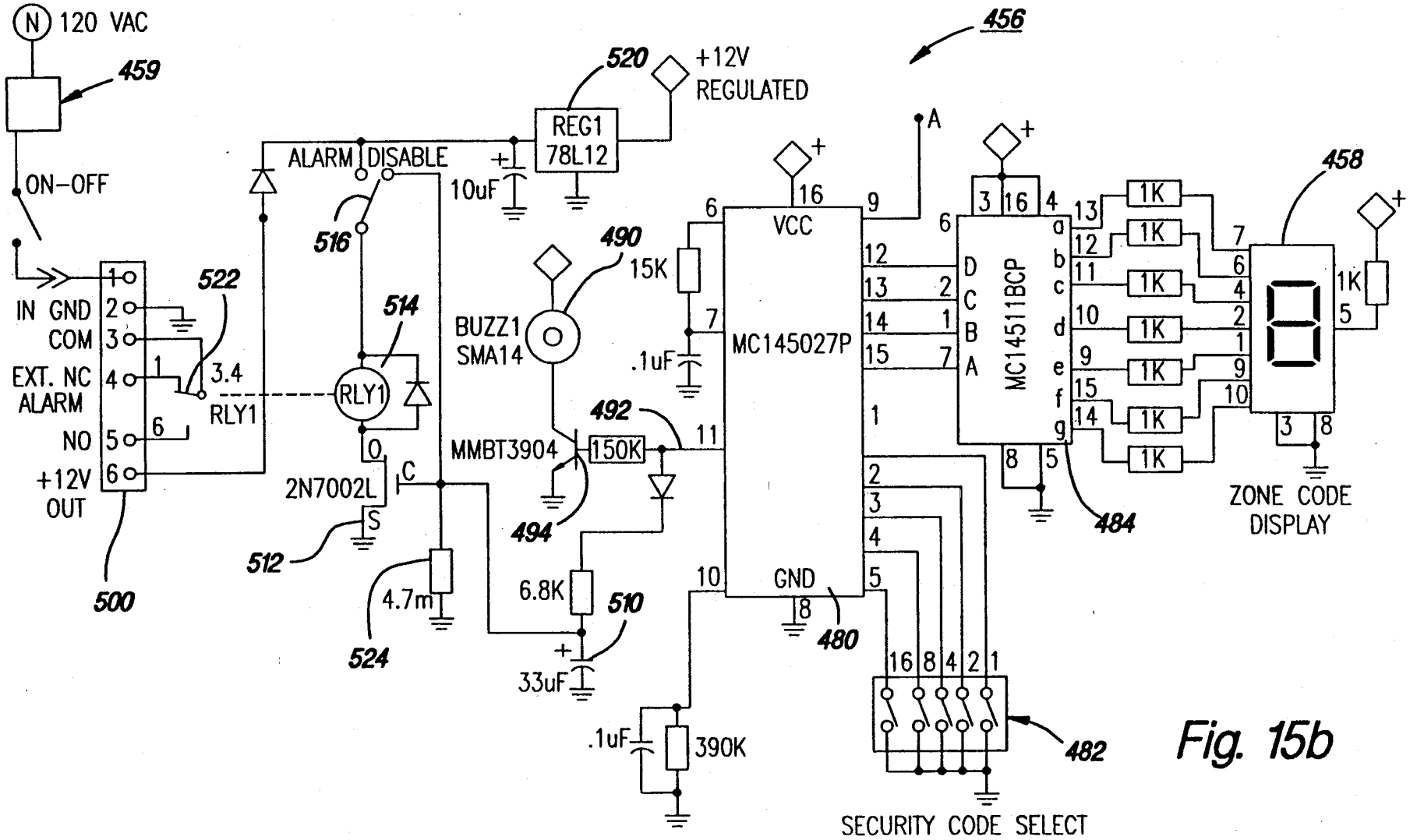

The signal generator 322 is illustrated by FIGS. 13, 15A and 15B and comprises a housing 455, a signal generator circuit 456 supported by the housing, an audible alarm producing device 457 operated by the circuit 456, an alarm condition location display 458, and a power supply device 459 (FIG. 15B). The signal generator 322 is electrically connected to the building power mains via the power supply device. The signal generator 322 is preferably a model RC 200 Wireless Siren/-Receiver/Controller available from Larmco Security, Inc., referred to above.

The coded RF output signal is received and evaluated by the signal generating circuit 456 (FIGS. 15A and 15B). This circuit is mounted to a printed circuit board (not illustrated) and includes an antenna 460 and a superregenerative detector circuit 462 tuned to a frequency of 303.875 megahertz. The antenna 460 is isolated from the detector circuit 462 by a dual-gate MOSFET amplifier circuit 464. The receive frequency of the detector circuit 462 is tuned by adjusting a variable inductor 466.

An audio amplifier circuit 470 is coupled to the output from the detector circuit 462 and increases the level of the output of this detector circuit to a level which can be processed by a filter and level detector circuit 472.

The circuit 472 removes noise and amplitude variations from the signals output from the audio amplifier circuit 470. An output from the circuit 472 includes a series of high and low signal levels corresponding to the encoded information transmitted from the oscillator circuit 430 concerning a sensed alarm condition.

An output A from the FIG. 15A circuitry is coupled to a decoder circuit 480 (FIG. 15B) which compares the security code portion of this signal with a code entered by means of a series of switches 482 coupled to the decoder circuit 480. Before the decoder 480 responds to an alarm condition indication from the encoder circuit 410 a correspondence must exist between the security codes programmed at the input 450 and the code programmed at the switches 482.

If the security codes match, the decoder circuit 480 interprets the zone indication transmitted from the encoder 410 and activates an LED driver circuit 484. A connection between the driver circuit 484 and the decoder 480 is a parallel 4 bit connection allowing each of 10 digits 0–9 to be displayed on the alarm condition location display 458. The display 458 constitutes, in the illustrated embodiment, a "zone" code display in that adjacent windows in the building may each be fabricated to produce alarm condition RF signals having a common identification code. The display 458 shows the "zone" in which a window has transmitted an alarm condition signal.

The display 458 is constructed using a conventional 7 segment LED display. The display driver 484 receives a digital signal and activates an appropriate configuration of LED segments to display the zone code of the circuit sensing a security breach.

In addition to activating the display 458, the decoder 480 activates the audible alarm producing device 457. A high signal at an alarm output 492 turns on a transistor 494 to energize the device 457 which may be a piezo electric resonant siren or horn, or the like.

The second signal generator circuit 456 can also activate an external alarm. An alarm circuit interface 500 can be connected to an external alarm or other indicating circuitry. When the output signal at the decoder output 492 goes high in response to a match between the security codes a capacitor 510 charges to a voltage sufficiently high to turn on a transistor 512 coupled to a relay coil 514. If a user actuated switch 516 is moved to a position to enable the external alarm, when the transistor 512 turns on, the coil 514 is energized by a 12 volt signal input to the interface 500 from the power supply 459 which is preferably a commercially available isolation transformer for stepping down 120 VAC to 12 VAC. A relay contact 522 switches from a normally closed to an open position and this state change can be used for activating the external alarm. The signal generator 322 may also interface with other security systems, and other auxiliary equipment such as auto-dialers, supervised monitoring services, and strobe lights.

Once the capacitor 510 is charged by the signal at the output 492, it remains charged even though the output 492 from the decoder 480 goes low. The capacitor 510 maintains its charge for a period of approximately 5 minutes. It discharges with a time constant defined by the capacitance of the capacitor 510 and the resistance of a discharge resistor 524. After the 5 minute discharge period the gate voltage on the transistor 512 is reduced to a point that the transistor 512 turns off and the relay coil 514 is deenergized.

The twelve volt AC input to the interface 500 is coupled through a half wave rectifier formed by a diode and a filter capacitor to a voltage regulator 520. This regulator 520 provides a regulated twelve volt DC signal to the decoder 480, LED driver 484 and the display 458. Additionally, if the external alarm requires an additional power source the twelve volt signal can be routed to the external alarm. One suitable DC twelve volt converter can supply up to 500 miliamps to such an external alarm.

While preferred embodiments of the invention have been illustrated and described in detail, the present invention is not to be considered limited to the precise constructions disclosed. Various adaptations, modifications and uses of the invention may occur to those skilled in the art to which the invention relates and the intention is to cover hereby all such adaptations, modifications and uses which fall within the spirit or scope of the appended claims.

Having described our invention we claim:

1. An anti-intrusion window comprising:

a. a frame assembly adapted to be attached to a building structure;

b. a first sash assembly supported by the frame assembly for movement with respect to said frame assembly along a path of travel from a closed position;

c. a second sash assembly supported by said frame assembly;

d. a position indicator supported by one of said sash assemblies;

e. a sensor supported by the other of said sash assemblies, said sensor and said position indicator moving with respect to one another when said first sash assembly is moved along said path of travel relative to said second sash assembly, said sensor effective to detect the presence of said position indicator near said sensor; and, f. an alarm system for triggering an alarm in response to the momentary presence of said position indicator near said sensor;

g. said position indicator and said sensor supported at locations spaced apart along said path of travel when said first and second sash assemblies are positioned at respective closed positions so that said alarm system is ineffective to trigger an alarm until the window is opened a predetermined amount.

2. An anti-intrusion window according to claim 1 wherein said position indicator is a magnet and said sensor is responsive to the momentary presence of a magnetic field produced by said magnet.

3. An anti-intrusion window according to claim 1 wherein said position indicator is supported by said first sash assembly disposed in a first plane and said sensor is supported by said second sash assembly disposed in a second plane, said second plane lying between said first plane and the interior of the building.

4. An anti-intrusion window according to claim 3 wherein said second sash assembly comprises an elongated sash member engaging said frame assembly and movable longitudinally along a second path of travel, said sensor supported by said said sash member.

5. An anti-intrusion window according to claim 1 wherein said first sash assembly is movable along a path of travel between said closed position and a range of open ventilating positions, and further including connecting structures associated with said position indicator and said sensor for connecting the position indicator and sensor to respective sash assemblies at respective locations where the indicator and sensor remain spaced apart throughout a predetermined range of open ventilating positions of said first sash assembly to prevent detection.

6. An anti-intrusion window as claimed in claim 1 wherein said alarm system comprises an alarm signal generator supported by said other sash assembly, said alarm signal generator connected to said sensor and producing an alarm signal in response to said sensor detecting said position indicator.

7. The window claimed in claim 6 further including means for coding the signal produced by said alarm signal generator to indicate the window location.

8. The window claimed in claim 6 further including a second alarm signal generator located remote from said window, said second alarm signal generator receiving signals from said first signal generator and producing an alarm.

9. The window claimed in claim 6 wherein said alarm signal generator comprises a circuit for producing and transmitting a radio frequency alarm signal.

10. The window claimed in claim 1 wherein said position indicator comprises a permanent magnet attached to said sash assembly by an adhesive tape material.

11. An anti-intrusion window comprising:

a. a frame assembly adapted to be attached to a building structure;

b. a first sash assembly supported by the frame assembly for movement with respect to said frame assembly along a path of travel from a closed position;

c. a second sash assembly supported by said frame assembly for movement with respect to said frame assembly along a second path of travel adjacent and parallel to said first path of travel, said second sash assembly movable from a closed position;

d. a position indicator supported by one of said sash assemblies;

e. a sensor supported by the other of said sash assemblies so that said sensor and said position indicator move with respect to one another when either of said sash assemblies is moved along its respective path of travel, said sensor effective to detect the presence of said position indicator near said sensor; and, f. an alarm system for triggering an alarm in response to the momentary presence of said position indicator near said sensor;

g. said position indicator and said sensor supported at locations spaced substantially apart in the direction of said paths of travel when said sash assemblies are positioned at their respective closed positions so that said sash assemblies may be moved relative to each other from their closed positions without triggering an alarm.

12. An anti-intrusion window as claimed in claim 11 wherein said alarm system comprises an alarm signal generator supported by said other sash assembly, said alarm signal generator connected to said sensor and producing an alarm signal in response to said sensor detecting said position indicator.

13. The window claimed in claim 12 further including means for coding the signal produced by said alarm signal generator to indicate the window location.

14. The window claimed in claim 13 further including a second alarm signal generator located remote from said window, said second alarm signal generator receiving signals from said first signal generator and producing an alarm.

15. The window claimed in claim 12 wherein said alarm signal generator comprises a circuit for producing and transmitting a radio frequency alarm signal.

16. The window claimed in claim 11 wherein said position indicator comprises a permanent magnet attached to said sash assembly by an adhesive tape material.

* * * * *